US007106264B2

(12) United States Patent
Lee et al.

(10) Patent No.: US 7,106,264 B2
(45) Date of Patent: Sep. 12, 2006

(54) BROADBAND SLOT ANTENNA AND SLOT ARRAY ANTENNA USING THE SAME

(75) Inventors: Jong Moon Lee, Chungcheongbuk-do (KR); Yong Heui Cho, Daejon (KR); Jae Ick Choi, Daejon (KR); Sig Pyo Cheol, Daejon (KR); Jong-Suk Chae, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 10/650,406

(22) Filed: Aug. 27, 2003

(65) Prior Publication Data

US 2004/0169604 A1 Sep. 2, 2004

(30) Foreign Application Priority Data

Feb. 27, 2003 (KR) ..... 10-2003-0012439

(51) Int. Cl.
*H01Q 13/10* (2006.01)

(52) U.S. Cl. ..... 343/767

(58) Field of Classification Search ..... 343/767, 343/746, 755, 775, 845, 846
See application file for complete search history.

(56) References Cited

U.S. PATENT DOCUMENTS 4,987,423 A * 1/1991 Bouko et al. ..... 343/741
5,614,915 A * 3/1997 Webb ..... 343/770
5,990,835 A * 11/1999 Kuntzsch et al. .... 343/700 MS
6,188,368 B1 2/2001 Koriyama et al.
6,351,240 B1 * 2/2002 Karimullah et al. . 343/700 MS
6,359,588 B1 * 3/2002 Kuntzsch ..... 343/700 MS
6,507,321 B1 * 1/2003 Oberschmidt et al. ..... 343/770
6,774,851 B1 * 8/2004 Cuhaci et al. ..... 343/700 MS

FOREIGN PATENT DOCUMENTS

JP 11-186838 7/1999
KR 10 2001 1105 3/2001

OTHER PUBLICATIONS

Gabriel M. Rebeiz, et al. "Integrated Horn Antennas for Millimeter-Wave Applications", IEEE Antennas and Propagation Magazine, vol. 34, No. 1, Feb. 1992, pp. 7-16.

* cited by examiner

*Primary Examiner*—Trinh Dinh
*Assistant Examiner*—Huedung X. Cao
(74) *Attorney, Agent, or Firm*—Blakely Sokoloff Taylor & Zafman

(57) ABSTRACT

The present invention provides a broadband slot array antenna that can be implemented with lower cost by using a single dielectric layer and a metal layer, and makes easy to implement an active integrated antenna. The broadband slot antenna includes: a dielectric layer under which a microstrip feedline is formed; a ground formed on the dielectric layer and electromagnetically coupled with the microstrip antenna through a slot; and a reflection plane placed under the microstrip feedline in order to prevent board surface waves from being radiated and enhance antenna gain.

4 Claims, 7 Drawing Sheets

BROADBAND SLOT ANTENNA AND SLOT ARRAY ANTENNA USING THE SAME

FIELD OF THE INVENTION

The present invention relates to a broadband slot antenna and a slot array antenna using the broadband slot antennas; and, more particularly, to a broadband slot antenna in which a radiating plane is electromagnetically coupled to a feedline and a slot array antenna using the broadband slot antennas.

DESCRIPTION OF RELATED ART

An electromagnetically coupled patch array antenna having slots is broadly used because it is easy to attach another circuit to a microstrip feedline and feeding loss is reduced by separating a feedline and an antenna and decreasing permittivity of a board used for a feedline circuit. Although the electromagnetically coupled patch array antenna having slots has broad bandwidth characteristics, antenna gain is low and a ground plane cannot be used as a radiating plane in implementing an active device antenna.

FIGS. 1A and 1B are a cross-sectional view and a prospective view of a conventional electromagnetically coupled patch antenna having a slot.

Referring to FIGS. 1A and 1B, a ground plane 13 is formed on a lower dielectric board 15 and has a slot 14 on an opposite side to a dielectric board 12 such as a printed circuit board (PCB) and a feedline 16 is placed under the dielectric board 15. A radiating patch 11 is formed on an upper dielectric board such as a PCB and a conductor placed under the upper dielectric board 12 is completely removed.

Therefore, the electromagnetically coupled patch antenna having a slot provides a broadband axial ratio and broadband impedance bandwidth characteristics by stacking a plurality of the upper dielectric boards 12 on which the radiating patch is formed. However, manufacturing cost is increased and antenna gain is low.

SUMMARY OF THE INVENTION

It is, therefore, a primary object of the present invention to provide a slot antenna using linear-polarized microstrip feeding and a broadband slot antenna enhancing electromagnetic coupling efficiency.

It is another object of the present invention to provide a slot array antenna by arranging broadband slot antennas and a broadband slot antenna using a baffle layer in order to reduce coupling of each slot antenna and enhance antenna gain.

In accordance with one aspect of the present invention, there is provided a broadband slot antenna including: a dielectric layer under which a microstrip feedline is formed; a ground formed on the dielectric layer for electromagnetically coupling the microstrip antenna through a slot; and a reflection plane placed under the microstrip feedline in order to prevent board surface waves from being radiated and enhance antenna gain.

In accordance with another aspect of the present invention, there is provided a slot array antenna, having broadband slot antennas, each including: a dielectric layer under which a microstrip feedline is formed; a ground formed on the dielectric layer for electromagnetically coupling the microstrip antenna through a slot; and a reflection plane placed under the microstrip feedline in order to prevent board surface waves from being radiated and enhance antenna gain, wherein a baffle layer is formed on the ground conductor in order to prevent mutual coupling and enhance antenna gain.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE INVENTION

Figure 1A:
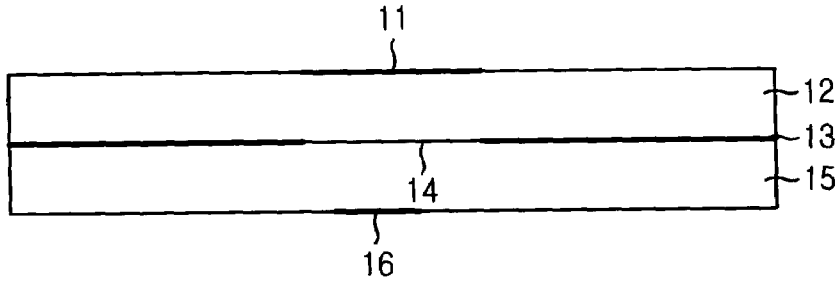
FIG. 1A (PRIOR ART)
FIGS. 1A and 1B are a cross-sectional view and a prospective view of a conventional electromagnetically coupled patch antenna having a slot.
Figure 1B:
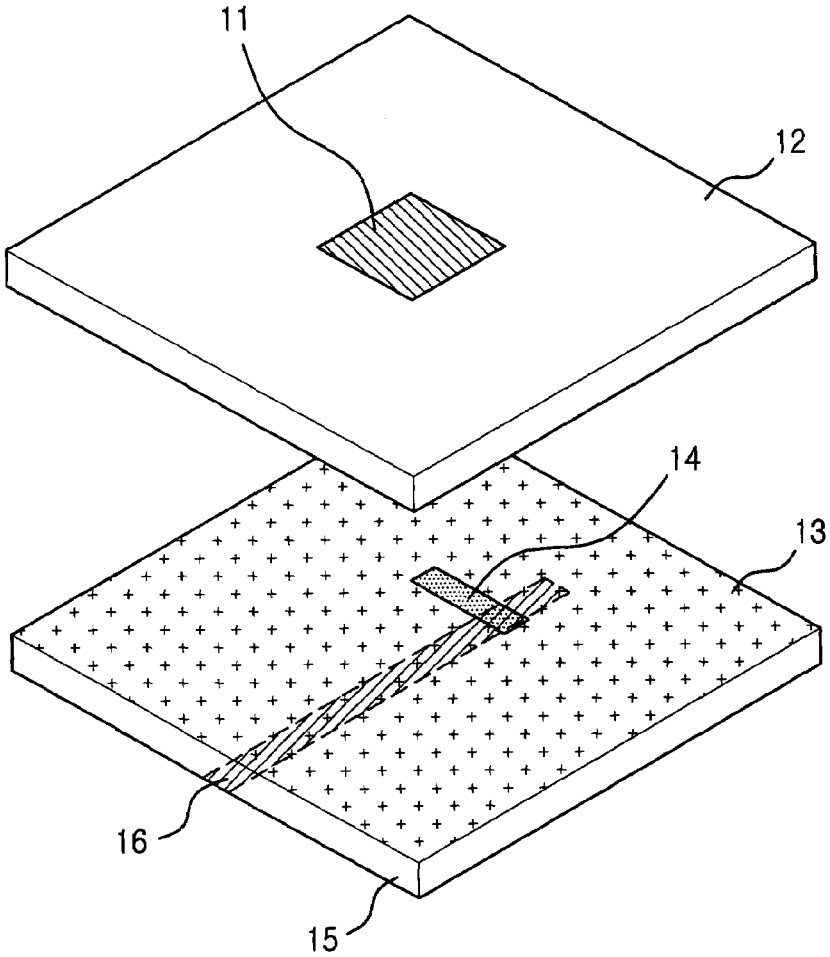
FIG. 1B (PRIOR ART)
Figure 2A:
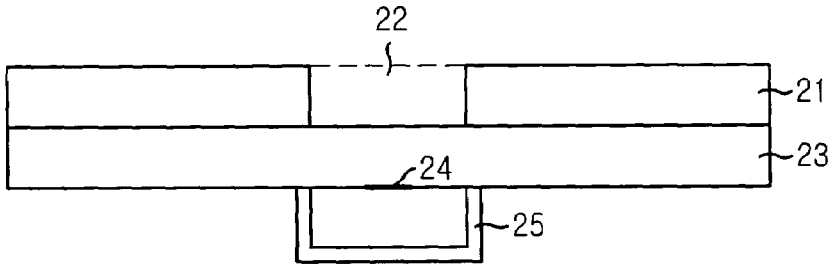
FIGS. 2A and 2B are a cross-sectional view and a prospective view of a single slot antenna having high efficiency in accordance with the present invention.
Figure 2B:
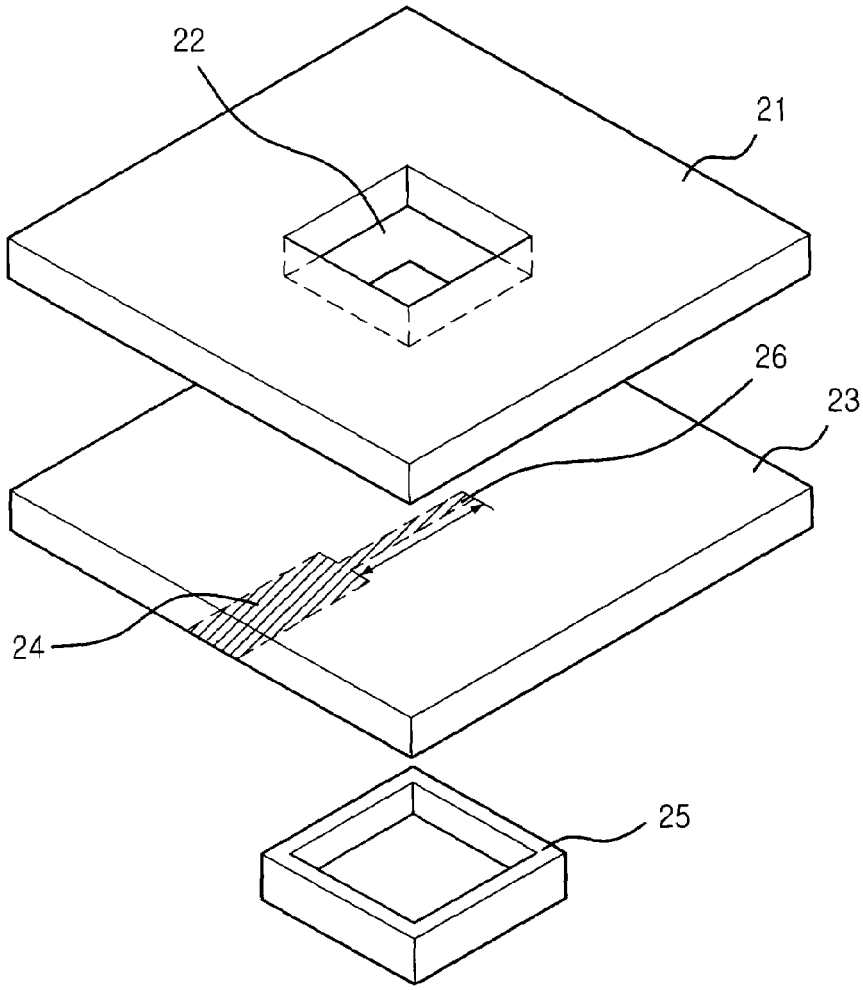

FIGS. 2A and 2B are a cross-sectional view and a prospective view of a single slot antenna having high efficiency in accordance with the present invention.

Referring to FIGS. 2A and 2B, the single slot antenna having high efficiency includes a ground conductor 21, a dielectric layer 23, a microstrip feedline 24 and a reflection plane 25.

The microstrip feedline 24 is formed under the dielectric layer 23. The ground conductor 21 is placed on the dielectric layer 23 and electromagnetically coupled to the microstrip feedline 24 through a slot. The reflection plane 25 is located under the microstrip feedline 24 and prevents board surface waves from being radiated. An open part having predetermined length and depth is located between the microstrip feedline 24 and the reflection plane 25 because the microstrip feedline 24 and the reflection plane 25 must not contact each other.

It is preferred that the dielectric layer 23 under which the microstrip feedline 24, the ground conductor 21 having the slot 22 and the reflection plane 25 are exactly aligned with each other in order to obtain enhanced coupling efficiency and the ground conductor 21 is made of red brass in order to easily coat gold on the surface of the ground conductor 21.

Also, the reflection plane 25 is a metal resonator for increasing antenna gain and preventing the board surface waves from being radiated.

Figure 2C:
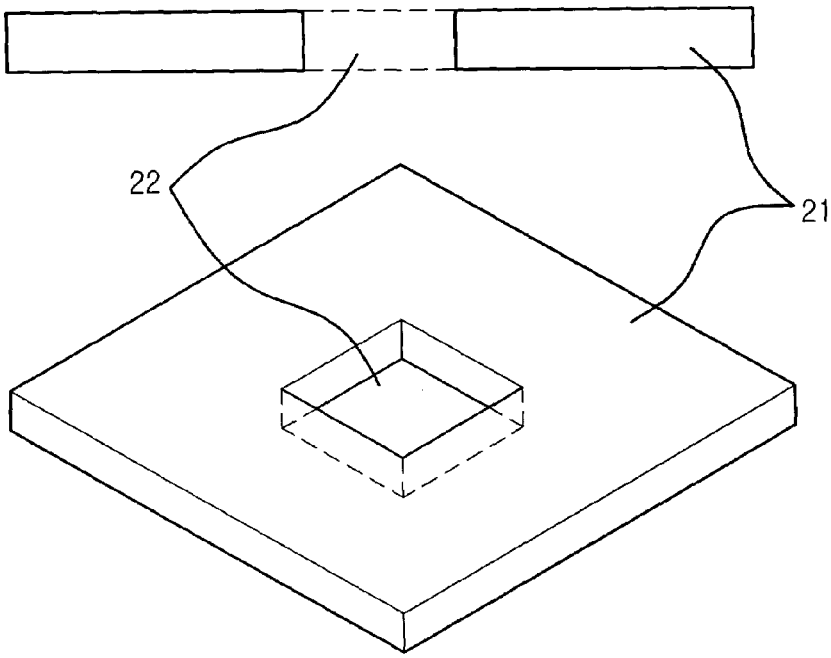
FIGS. 2C and 2D are a cross-sectional view and a prospective view of a slot included in a ground conductor in accordance with the present invention.
Figure 2D:
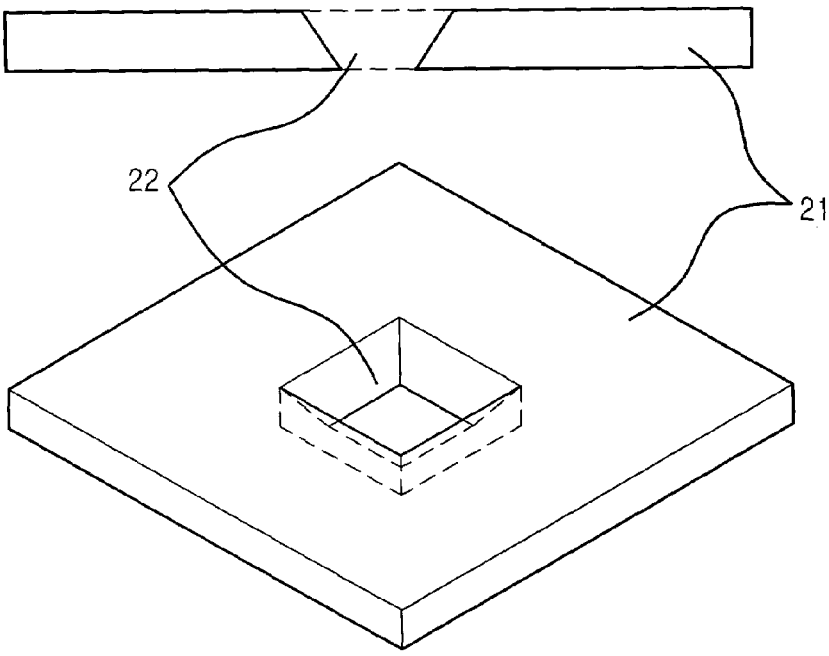

A gold-coated ground conductor 21 having a slot 22 is formed on the dielectric layer 23 with reference to FIGS. 2C and 2D.

Referring to FIG. 2C, areas of an entrance and a bottom of the slot are the same and referring to FIG. 2D, an area of an entrance of the slot is larger than that of a bottom of the slot.

Therefore, a linear-polarized wave having advanced coupling efficiency is obtained by exactly aligning the reflection plane 25, the dielectric layer 23 and the ground conductor 21 having single slot. Also, if multi-resonance occurs, broadband antenna characteristics are obtained. A resonance frequency is controlled by varying a height of the reflection plane 25 and a length of a tip part of feedline 24.

A 2×2 array antenna is formed by arranging the broadband slot antennas of the present invention.

Figure 3A:
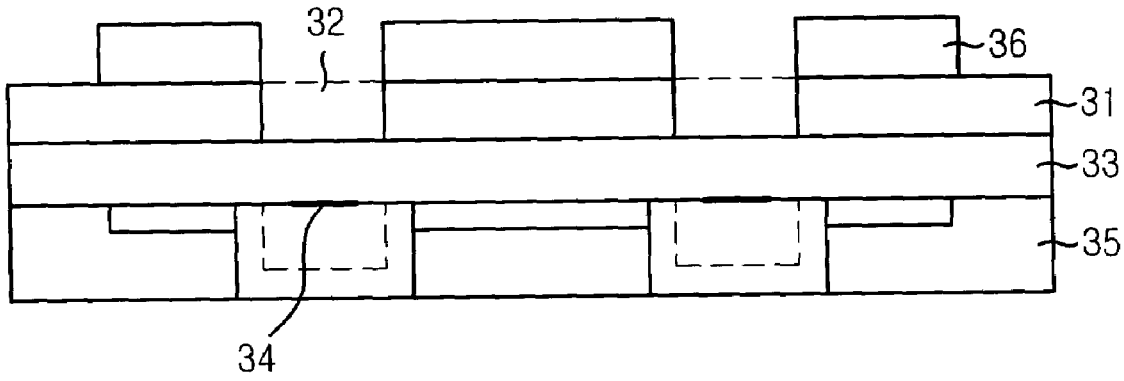
FIGS. 3A and 3B are a cross-sectional view and a perspective view showing a 2×2 array antenna formed by arranging the broadband single slot antennas in accordance with the present invention.
Figure 3B:
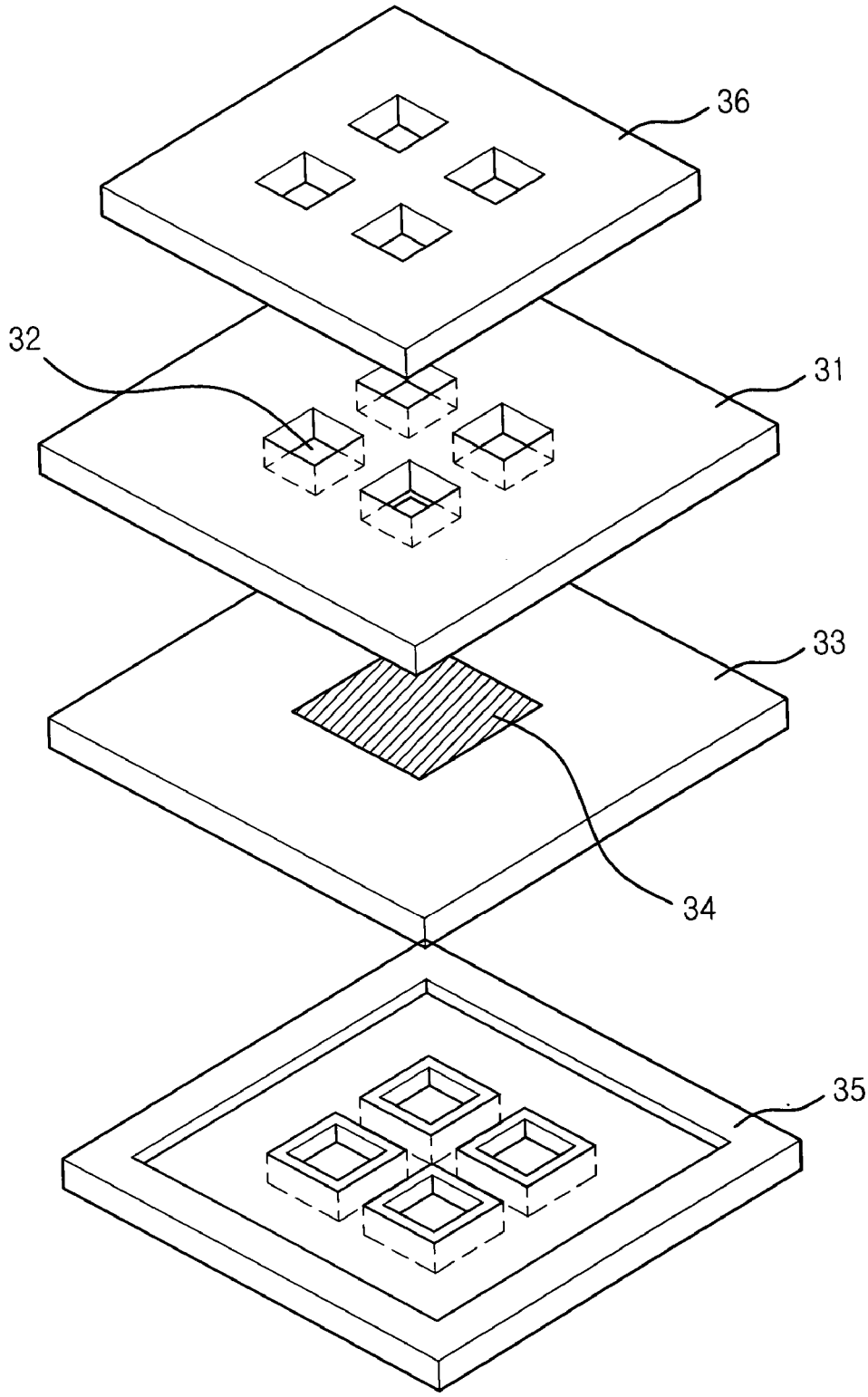

FIGS. 3A and 3B are a cross-sectional view and a perspective view showing a 2×2 array antenna formed by arranging the broadband slot antennas in accordance with the present invention.

Figure 4:
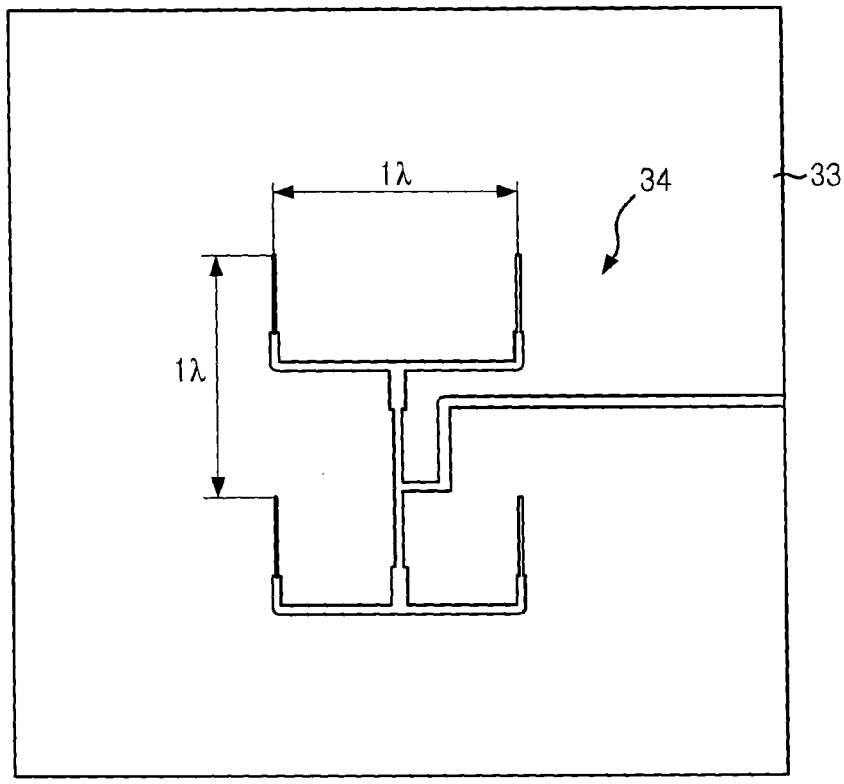
FIG. 4 is a top view showing a 2×2 array antenna formed by arranging the broadband single slot antennas in accordance with the present invention.

FIG. 4 is a top view showing a 2×2 array antenna formed by arranging the broadband single slot antenna in accordance with the present invention.

Referring to FIGS. 3A and 3B, the broadband slot array antenna includes a microstrip feedline 34, a dielectric layer 33, a ground conductor 31, a reflection layer 35 and a baffle layer 36.

The dielectric layer 33 separates the ground conductor 31 and the microstrip feedline 34 and the ground conductor 31 is electromagnetically coupled with the microstrip feedline 34 through a slot 32. Also, the reflection plane 35 prevents board surface wave from radiating and the baffle layer 36 prevents mutual coupling of the slot antennas in order to increase antenna gain. The baffle layer 36 is a square shape.

As mentioned with FIGS. 2A and 2B, the baffle layer 36, the reflection plane 35, the dielectric layer 33 and the ground plane 31 is exactly aligned in order to obtain enhanced coupling efficiency. The linear-polarized wave having enhanced coupling efficiency has the same structure shown in FIGS. 3A and 3B.

Referring to FIG. 3B, the 2×2 array antenna is composed of single slot antennas. A distance between slots becomes less than 1λ in order to decrease a size of side lobe. The reflection plane 35 prevents backward radiation while antenna gain is increased by using a wide slot. Also, the reflection plane 35 decreases effect of board surface wave at millimeter wave band by blocking the microstrip feedline 34. The baffle layer 36, the ground conductor 31, dielectric layer 33 and the reflection plane 35 are exactly aligned as shown in FIGS. 3A and 3B in order to obtain enhanced coupling efficiency.

Figure 5:
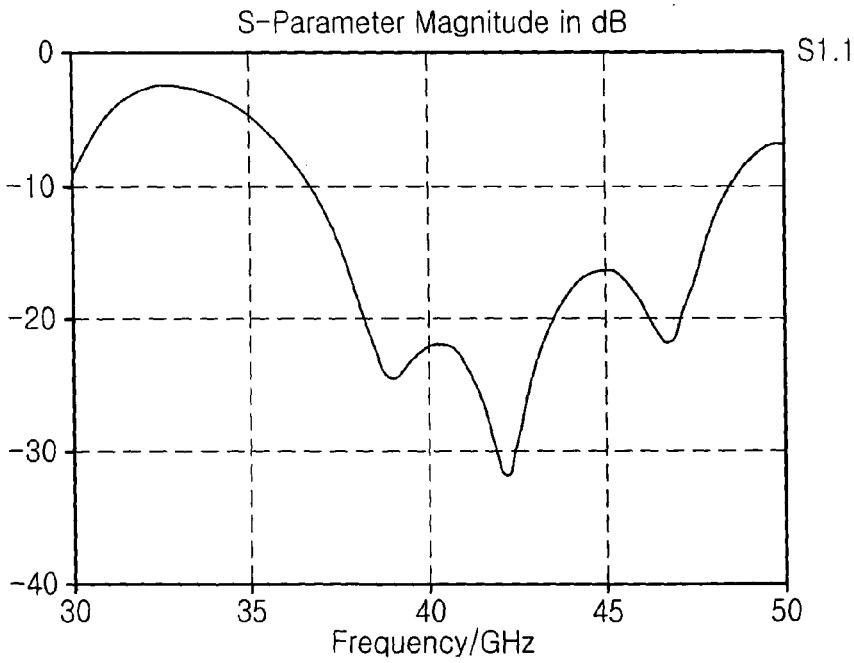
FIG. 5 is a graph showing return loss of the wide slot array antenna having high efficiency in accordance with the present invention.

FIG. 5 is a graph showing return loss of the wide slot array antenna having high efficiency in accordance with the present invention.

Figure 6A:
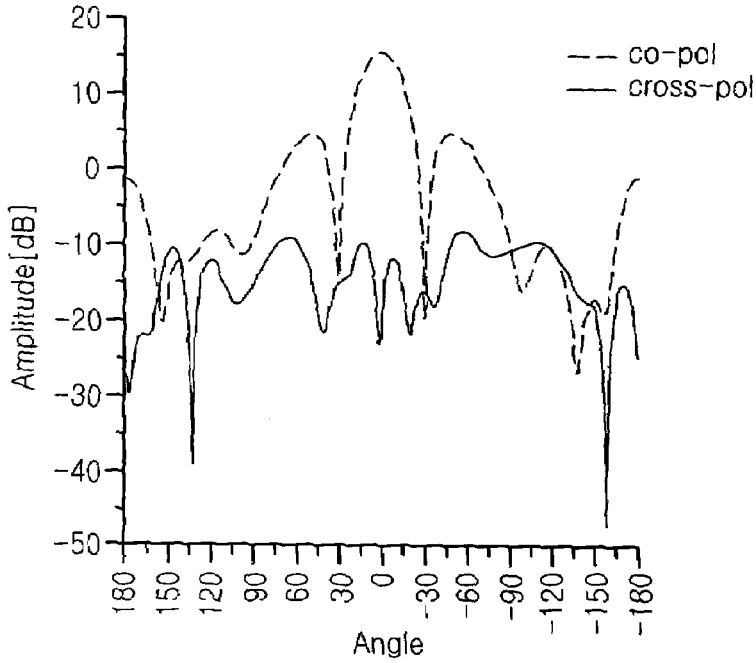
FIGS. 6A and 6B are graphs showing radiating patterns of the wide slot array antenna having high efficiency in accordance with the present invention.
Figure 6B:
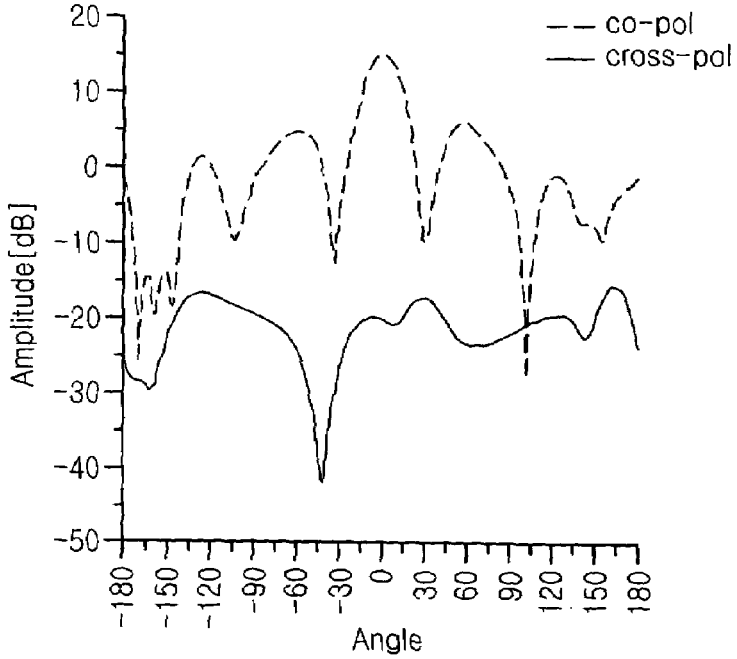

FIGS. 6A and 6B are graphs showing radiating patterns on H plane and E plane of the wide slot array antenna having high efficiency in accordance with the present invention.

Referring to FIGS. 5, 6A and 6B, the present invention provides better performance than the conventional art in aspects of the return loss and the radiating patterns.

In accordance with the present invention, 10 dB return loss bandwidth is 30%, i.e., center frequency is 42 GHz, 3 dB beam width is ±13°, and antenna gain is 15.5 dB.

As mentioned above, the present invention can obtain great performance in impedance bandwidth, 3 dB beam width and antenna gain by implementing a new structure of single slot antenna using the ground conductor having the slot and the baffle layer, the dielectric layer and reflection layer.

Also, the present invention can be implemented with lower cost by using a single dielectric layer and a metal layer, and makes easy to implement an active integrated antenna.

While the present invention has been shown and described with respect to the particular embodiments, it will be apparent to those skilled in the art that many changes and modifications may be made without departing from the spirit and scope of the invention as defined in the appended claims.

What is claimed is:

1. A slot antenna, comprising broadband slot antennas, wherein each of the broadband slot antennas includes:

a dielectric layer under which a microstrip feedline is formed;

a ground formed on the dielectric layer and electromagnetically coupled with the microstrip antenna through a slot; and a reflection plane placed under the microstrip feedline in order to prevent board surface waves from being radiated and enhance antenna gain, wherein a baffle layer is formed on the ground conductor in order to prevent mutual coupling between the slot antennas and enhance antenna gain.

2. The slot array antenna as recited in claim 1, wherein the baffle layer reduces the mutual coupling between the slot antennas while arranging the broadband slot antennas and enhances antenna gain.

3. The antenna as recited in claim 1, wherein area of an entrance of the slot is the same as that of a bottom of the slot or area of the entrance of the slot is different from that of the bottom of the slot.

4. The antenna as recited in claim 1, wherein the reflection plane is a metal resonator.

* * * * *